US007825819B2

(12) United States Patent
Muralidharan et al.

(10) Patent No.: US 7,825,819 B2
(45) **Date of Patent: *Nov. 2, 2010**

(54) REMOTE SHOCK SENSING AND NOTIFICATION SYSTEM

(75) Inventors: Govindarajan Muralidharan, Knoxville, TN (US); Charles L. Britton, Alcoa, TN (US); James Pearce, Lenoir City, TN (US); Usha Jagadish, Knoxville, TN (US); Vinod K. Sikka, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/268,657

(22) Filed: Nov. 11, 2008

(65) Prior Publication Data

US 2009/0072964 A1 Mar. 19, 2009

Related U.S. Application Data

(63) Continuation of application No. 11/346,867, filed on Feb. 3, 2006, now Pat. No. 7,450,023.

(51) Int. Cl.
*G08B 21/00* (2006.01)

(52) U.S. Cl. ..... 340/665; 220/200; 235/385

(58) Field of Classification Search ..... 340/669, 340/539.1, 539.22, 539.23, 665; 220/200, 220/203.18, 203.22; 235/385
See application file for complete search history.

(56) References Cited

U.S. PATENT DOCUMENTS 4,102,394 A 7/1978 Botts
5,585,566 A * 12/1996 Welles et al. ..... 73/654
7,038,585 B2 * 5/2006 Hall et al. ..... 340/539.22
7,042,365 B1 * 5/2006 Diaz-Lopez ..... 340/690
2003/0190906 A1 * 10/2003 Winick ..... 455/404.1
2004/0174260 A1 * 9/2004 Wagner ..... 340/568.1
2007/0152815 A1 * 7/2007 Meyers et al. ..... 340/539.22
2007/0152824 A1 * 7/2007 Waterhouse et al. ..... 340/572.1
2007/0152826 A1 * 7/2007 August et al. ..... 340/572.1

OTHER PUBLICATIONS

"Advanced Sensor System for Energy Infrastructure Assurance", Jan. 2004, Office of Energy Assurance, U.S. Department of Energy, 2 pages.

* cited by examiner

*Primary Examiner*—Davetta W Goins
*Assistant Examiner*—Edny Labbees
(74) *Attorney, Agent, or Firm*—Novak Druce + Quigg LLP; Gregory A. Nelson; Eduardo J. Quinones

(57) ABSTRACT

A low-power shock sensing system includes at least one shock sensor physically coupled to a chemical storage tank to be monitored for impacts, and an RF transmitter which is in a low-power idle state in the absence of a triggering signal. The system includes interface circuitry including or activated by the shock sensor, wherein an output of the interface circuitry is coupled to an input of the RF transmitter. The interface circuitry triggers the RF transmitter with the triggering signal to transmit an alarm message to at least one remote location when the sensor senses a shock greater than a predetermined threshold. In one embodiment the shock sensor is a shock switch which provides an open and a closed state, the open state being a low power idle state.

19 Claims, 6 Drawing Sheets

400

REMOTE SHOCK SENSING AND NOTIFICATION SYSTEM

CROSS REFERENCE TO RELATED APPLICATIONS

This application is a continuation of U.S. application Ser. No. 11/346,867, filed Feb. 3, 2006 and issued as U.S. Pat. No. 7,450,023 on Nov. 11, 2008.

STATEMENT REGARDING FEDERALLY SPONSORED RESEARCH OR DEVELOPMENT

The United States Government has rights in this invention pursuant to contract no. DEAC05-00OR22725 between the United States Department of Energy and UT-Battelle, LLC.

FIELD OF THE INVENTION

The present invention relates to low-power shock sensing systems including wireless communications for detection and remote communications of impacts.

BACKGROUND OF THE INVENTION

Significant quantities of energy assets including heating oil, diesel fuel, and gasoline are stored and transported within the United States and other areas of the developed world which constitute a vital part of the energy infrastructure. Energy asset storage tanks are vulnerable to malicious acts with potentially serious consequences including fire, explosion, environmental damage, potential loss of life, and economic losses due to release of materials and damage to infrastructure. Thus, there is a significant need for protection of critical infrastructure such as energy storage facilities that store gasoline and other hydrocarbons which are spread over a large land expanse. For example, it is important to know if there has been any significant damage to such infrastructure through impacts and verify the presence of absence of leaks of stored chemicals. Such impacts could arise from objects such as hammers or from the impact of projectiles such as bullets.

Not only is there a need to know if such impacts have occurred, but there is also a need to find out the nature, extent and consequences of the impact. It would also be convenient if the information regarding such impacts from a plurality of spaced apart locations could be transmitted to one or more remote monitoring locations.

SUMMARY

A low-power shock sensing system comprises at least one shock sensor physically coupled to a chemical storage tank to be monitored for impacts and an RF transmitter. The RF transmitter is in a low-power idle state in the absence of a triggering signal. The system includes interface circuitry including and/or activated by the shock sensor, wherein an output of the interface circuitry is coupled to an input of the RF transmitter. The interface circuitry triggers the RF transmitter with the triggering signal to transmit an alarm message to at least one remote location when the sensor senses a shock greater than a predetermined threshold.

The shock sensor can comprise a shock switch having an open and a closed state, the open state being a low power idle state, with the closed state being initiated by receipt of said shock greater than the predetermined threshold. The RF transmitter can comprise an RF transceiver. The remote location preferably includes a wireless transceiver system.

In one embodiment the shock sensor comprises a linear transducer. in this embodiment the system further comprises at least one comparator for comparing an analog output signal provided by the linear transducer to the predetermined threshold, wherein an output of the comparator activates the RF transmitter only when the analog output signal has an amplitude which is above the predetermined threshold.

The system preferably includes a battery. The RF transmitter can be powered exclusively by the battery. In one embodiment, the at least one shock sensor comprises a plurality of shock sensors. The plurality of shock sensors can have different predetermined thresholds. The plurality of shock sensors can comprise at least 3 shock sensors, wherein the plurality of shock sensors are situated on two or more planes (non-coplanar). In this embodiment, different time and amplitude signatures are produced from the same impact depending upon their respective distance from the impact allowing the position of the impact to be determined.

The system can comprise a plurality of chemical storage tanks. The system can further comprise a chemical sensor having RF communications disposed remotely and within a communicable range from the chemical storage tank, wherein the chemical sensor is in a low-power idle mode absent activation by receipt of an activation signal from the RF transmitter. The system can further comprise an explosion-proof housing, wherein shock sensor, RF transmitter and interface circuitry are disposed therein. The chemical tank comprises a hydrocarbon storage tank having a fuel therein.

BRIEF DESCRIPTION OF THE DRAWINGS

A fuller understanding of the present invention and the features and benefits thereof will be obtained upon review of the following detailed description together with the accompanying drawings, in which:

FIG. 1(*b*) shows exemplary interface circuitry comprising a pull-up resistor tied to the power supply voltage ($V_{batt}$) along with the shock switch. When the shock switch is closed the communications equipment transmits an alarm message.

FIG. 2(*b*) shows a detailed drawing of an exemplary interface board.

DETAILED DESCRIPTION

Figure 1A:
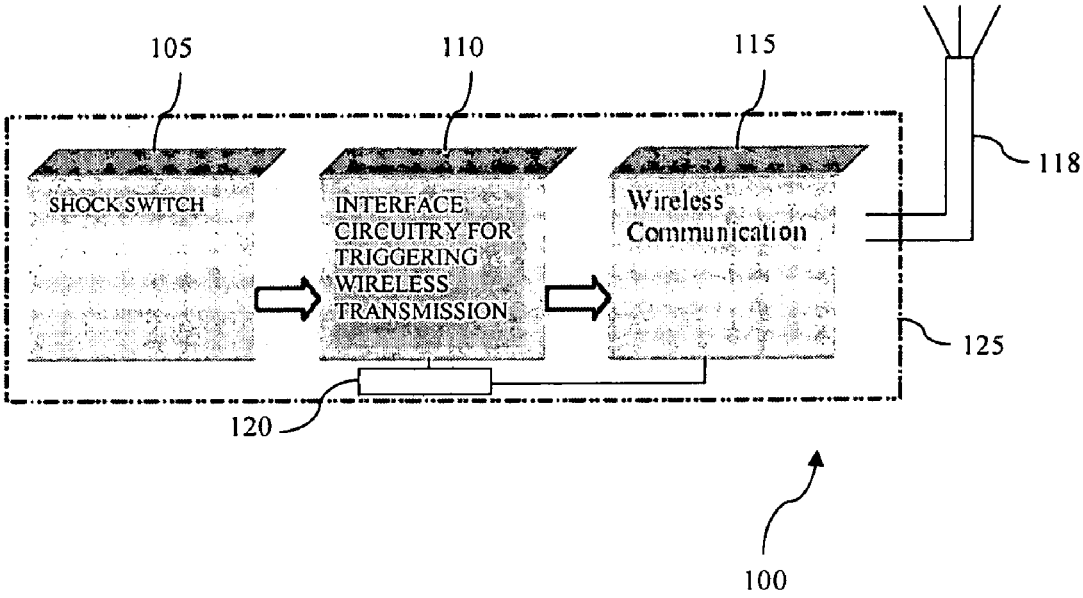
FIG. 1(*a*) shows an simplified schematic of a shock detection system according to an embodiment of the invention comprising a shock switch, interface circuitry and wireless communications equipment.

A low-power shock sensing system includes at least one shock sensor physically coupled to a chemical storage tank to be monitored for impacts, and an RF transmitter which is in a low-power idle state in the absence of a triggering signal. This feature enables practical battery operation and removes the need for electric service, thus facilitating remote sensing. The system includes interface circuitry including or activated by the shock sensor, wherein an output of the interface circuitry is coupled to an input of the RF transmitter. The interface circuitry triggers the RF transmitter with the triggering signal to transmit an alarm message to at least one remote location (e.g. control facility) when the sensor senses a shock greater than a predetermined threshold. In one embodiment the shock sensor is a shock switch that has at least two states including an open and a closed state. The open state is a low power idle state. The closed state is initiated upon receipt of a force having at least the predetermined threshold.

The control facility can respond rapidly to minimize potential losses and consequential damage to personnel and property. The RF transmitter is preferably an RF transceiver to permit the system to receive remotely transmitted signals, such as from a remotely located control center. The RF transmitter or RF transceiver can also be used in conjunction with the Internet if Internet capabilities are provided at the site.

In one embodiment, the shock sensor can be a linear transducer which measures the shock. When linear transducers are provided, sensor data is generally captured as analog data (e.g. a voltage level corresponding to a force). Although transducer data can be processed and transmitted as analog signals, analog signals generally produce high levels of noise in the transmissions which can lead to errors in parametric determinations based on received data.

Preferably, if analog data is acquired by the transducer, the analog data is digitized into bit streams using analog to digital (A/D) converters, and digitally filtered and encoded by a suitable device, such as a digital signal processor (DSP). This process is analogous to signal processing applied to voice signal in digital cellular communications. One or more modulated digital signals (e.g. from multiple sensors) each having sensor data can be combined into a single digital signal using a multiplexer, converted to an analog signal using a digital to analog (D/A) converter, up-converted in frequency (e.g. a local oscillator), and supplied to a broadband RF transmitter connected to an antenna for the wireless emission of a single multiplexed signal having the sensor information from the plurality of sensors digitally encoded therein. In the preferred embodiment of the invention, emitted signals are transmitted at a carrier frequency from approximately 900 MHz to 2.4 GHz. Emitted signals may also utilize spectral efficiency techniques known in the art such as time multiplexing (TDM), code division multi-access (CDMA), or other known spectral efficiency enhancing methodologies.

As known in the art of communications, emitted signals can include information to permit sensor/asset location to be determined from receipt of the signal. Specific carrier frequencies can be identified with specific assets being monitored. Transmitters can also be equipped with GPS. Alternatively, emitted signals from individual asset locations can include unique tones which can be identified with individual assets by reference to a registration list. Transmitted signals can include unique internet protocol (IP) type addresses permitting identification by reference to a registration list. Time multiplexing can also provide a method for identification of individual piles from the time of receipt of time synchronized signals, where multiple transmitters can share a given carrier frequency. A variety of other methods which permit asset location information to be determined from a received signal will be apparent to ones skilled in the art.

Figure 1B:
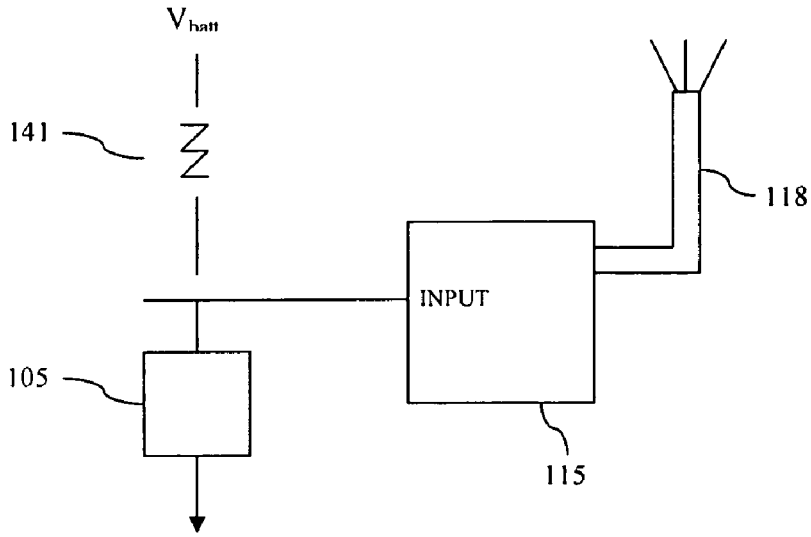

FIG. 1(*a*) shows a schematic of a shock detection system 100 according to an embodiment of the invention. The shock detection system 100 comprises a shock switch 105 that is activated (closed) by an impact force of a certain threshold magnitude. System 100 also includes a wireless communication system comprising an RF transmitter 115 coupled to antenna 118. Interface circuitry 110 is provided for triggering the RF transmitter 115 to transmit an alarm message to at least one remote location (e.g. control facility; not shown) when the shock switch 105 is closed. A power source 120 is provided for the RF transmitter 115, such as battery 120. Battery 120 can be a rechargeable battery. Although not shown in FIG. 1(*a*), a solar panel can be provided to recharge 120 using solar power.

System also preferably includes an explosion and fireproof housing 125. Housing 125 allows placement of system 100 in an environment prone to explosion or fire, such as a fuel (e.g. heating oil, diesel fuel or gasoline) storage tank. When there is no impact of at least the threshold magnitude, the RF transmitter is in a "waiting" or an idle mode consuming very little power. Wireless transmission is only triggered when a critical impact of at least the threshold magnitude is detected by the shock switch 105.

In one embodiment of the invention shown in FIG. 1(*b*), the output of shock switch 105 is connected to a digital input pin of a conventional RF data transceiver module 115. The digital input pin of exemplary RF data transceiver module 115 is sensitive to the falling edge of a logic signal. In this embodiment interface circuitry 110 comprises a pull-up resistor 141 tied to the power supply voltage ($V_{batt}$) along with switch 105 so that when the switch 105 is open the digital input pin has a logical high level. When the switch 105 closes the digital pin is pulled to ground which results in a falling edge to a logical low level. Thus, when switch 105 is closed interface circuit 110 triggers the transceiver 115 to transmit the alarm message. When interface circuit 110 is an interface module including a microprocessor, a specific time extender can be used to increase the sensitivity of the microprocessor to the trigger induced by the shock switch 105. An advantage of a microprocessor in the basic shock system is the flexibility of changing functional design without significant hardware changes in a quick and efficient manner if needed. The time extender elongates a shock pulse so that the processing stage that looks for the pulse will not miss the pulse due to inherent time constraints. It also can ensure that pulse jitters are masked so as not to cause multiple event counts.

A variety of shock switches 105 can be used with the invention. One type of shock sensor includes a weight, electrically connected to a terminal contact, suspended by a coil spring above a second terminal contact. The spring constant of the coil sets the magnitude of the impact to close the switch. Upon receipt of an appropriately large threshold impact, the sensor weight overcomes the spring force and makes contact with the second contact, thus completing (closing) the electric circuit.

Another type of shock sensor includes a weighted contact supported on a flexible cantilever-type spring. Yet another type of shock sensor includes a flexible diaphragm spring that is suspended above a terminal contact. The diaphragm spring is connected to a second contact and is wetted with a thin layer of mercury on the surface facing the terminal contact. In the event of a shock, the diaphragm spring is deflected such that the mercury wetted surface contacts the terminal contact. Such a device may not be usable over a wide range of G (acceleration due to gravity) forces.

System 100 enables detection of various kinds of impacts dealt to stationary infrastructure such as steel tanks storing gasoline and/or other related chemicals. System 100 can be attached to the infrastructure either using magnets or through a ring clamp, or any other suitable attachment structure.

As note above, systems according to the invention can include a shock sensor which provides a measurement related to the magnitude of the shock. In this embodiment, the system is preferably able to distinguish between small impacts that occur due to objects such as hammers from impacts due to high-velocity projectiles such as bullets.

A variety of known shock sensors 105 can be used with the invention. Different shock sensors generally provide measurements in different shock ranges. It is generally desirable to provide the capability to measure shocks from 20,000 to 150,000 G. Acceleration sensors may be used as shock sensor 105. Another type of shock sensor includes a strain gage mounted on a cantilevered plate that is designed to deflect in the region where the strain gage is mounted under shock or deceleration/acceleration forces. However, such sensors are relatively expensive to produce, and the electronics required to interpret the strain gage signals can be undesirably bulky.

Piezoelectrics (PE) may also be used for shock sensor 105. A significant advantage of PE sensors is that they are self-generating transducers. PE sensors produce a measurable electrical output signal without the use of an external electrical power source. This can be of great benefit in low-power designs. However, conventional piezoelectric accelerometers can only generally measure G levels in the range of 200 to several thousand G. Moreover, a design challenge associated with PE technology is that the output signal is high impedance and therefore prone to electromagnetic noise, and can be difficult to integrate into data acquisition systems. Known specialized charge-converter circuits can be used to transform the signal into a low-impedance output suitable for integration into standard A/D or control circuits.

The sensor can also comprises a linear mechanical transducer, such as a dynamic microphone. The response of such a transducer is a well-formed, well-timed, constant-delay electrical signal that can be used for time-of-transmission impact location if multiple transducers are employed. The required timing synchronization can be obtained from on-board GPS receivers. The advantage of the linear sensor is that the impact threshold can be set for virtually any threshold level dynamically for a single transducer in an adaptive manner. This embodiment allows a remote control facility to remotely alter the threshold level of the sensors.

Figure 2A:
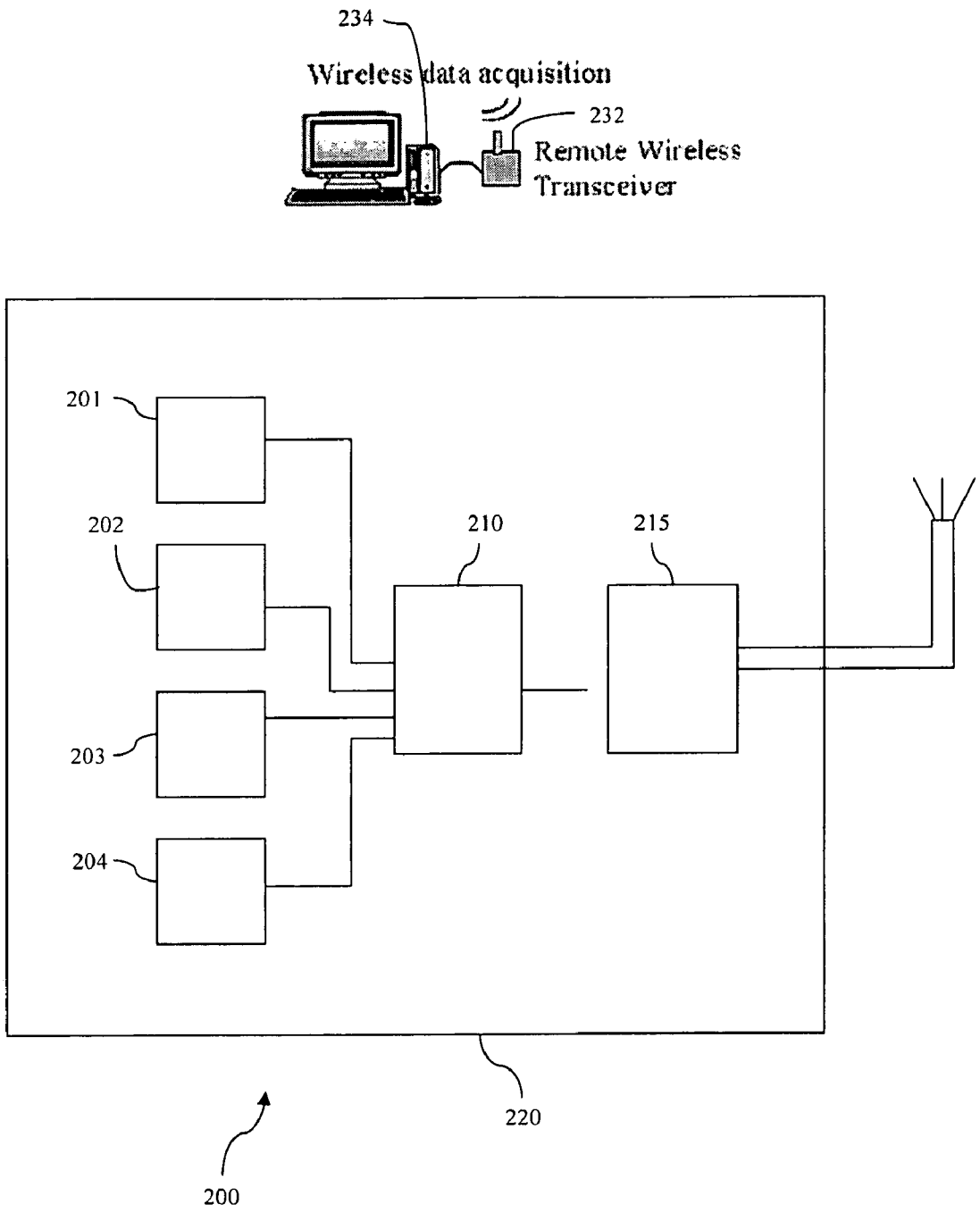
FIG. 2(*a*) shows a schematic of a sensor system which includes a plurality of shock sensors, each measuring different shock ranges.
Figure 2B:
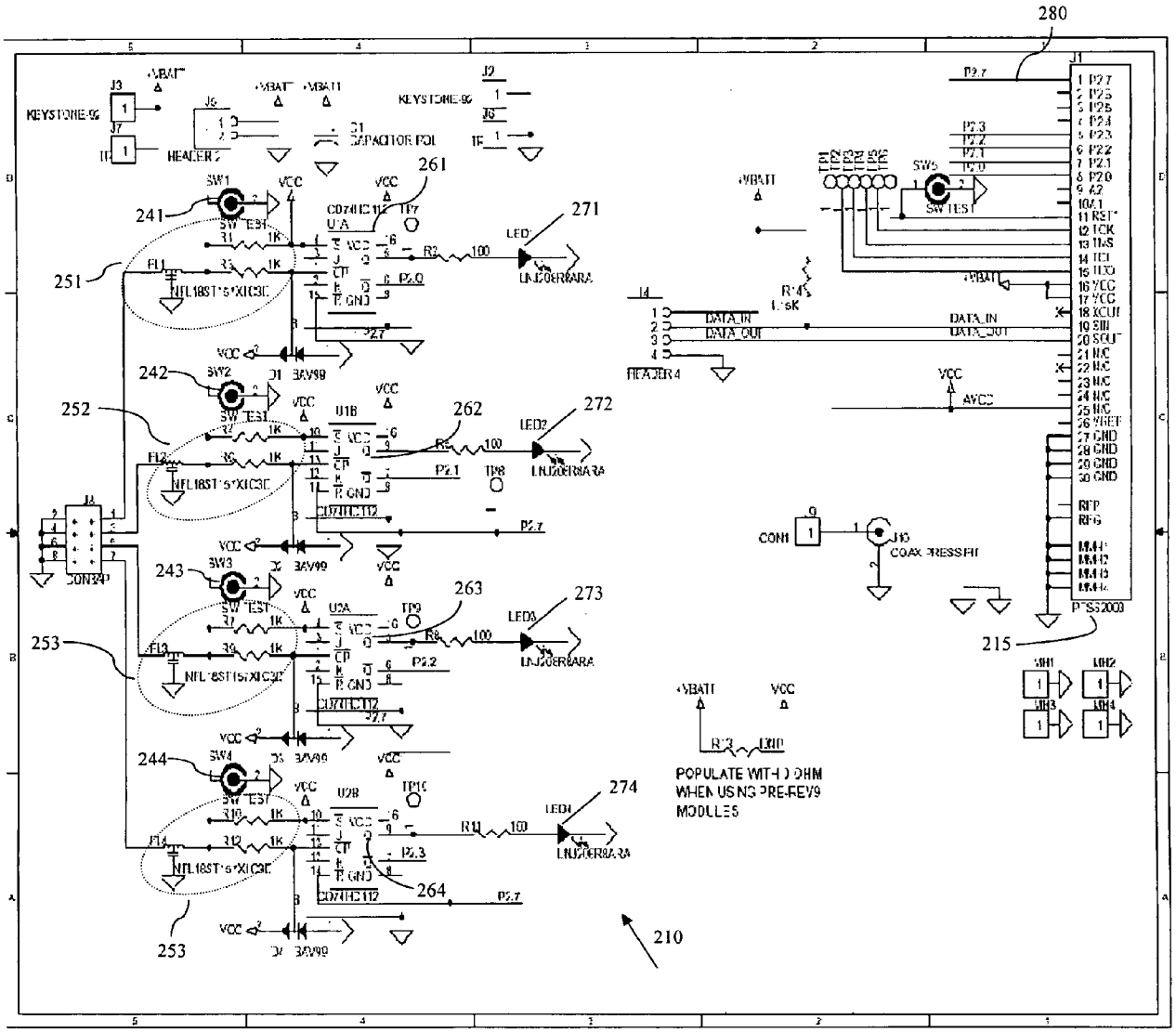

FIG. 2(*a*) shows a schematic of a sensor system 200 which includes shock sensors 201-204 each measuring different shock force ranges, with shock sensor 204 measuring the highest range, and shock sensor 201 measuring the lowest range (range 204>203>202>201). The nature of the impact can thus be classified either as due to day-to-day activities (low g-values; e.g. less than 2000 g routine vibrations due to motors, occasional impact with tools etc) or due to impact with bullets (high g-values; e.g. greater than 50,000 g). In this embodiment, shock sensors 201-204 are preferably vibration sensors, and a data acquisition interface 210 and wireless transmitter 215 are housed in housing 220 together and placed at the point of monitoring. Transmitter 215 is coupled to antenna 218 which emerges from housing 220. A wireless system 230 at a manned (or automatically monitored) point with a general user interface to a remotely located computer having a wireless data acquisition system/computer 234 and RF transceiver 232 completes the system 200.

Computer 234 determines shock information from received shock data provided by RF transmitter 215. Computer 234 can be a lap-top computer, or any other appropriate computing device. Using appropriate software, computer 234 can determine impact parameters including the force applied. In the event of detection of an appropriate shock level, transceiver 232 can automatically transmit or otherwise relay (e.g. Internet) the shock information to one or more first responders.

The interface board 210 takes in inputs from sensors 201-204 and feeds it to the transmitter 215. The interface board 210 is shown accepting signals from 4 different vibration sensors 201-204.

A detailed drawing regarding an exemplary interface board 210 is shown in FIG. 2(*b*). U1A, U1B, and U2A and U2B are JK flip-flops 261-264, while PTSS2003 (reference 215) is an RF transceiver module provided by Pegasus Technologies, Inc., Lenoir City, Tenn. The interface board 210 comprises of four independent, identical channels for separate g-switches 241-244. Each channel has input protection circuitry 251-254 to limit the possibility of damage from electrical transients, such as lightning strikes. The conditioned inputs (following switch 251-254 closures) trigger respective J-K Flip Flop (FF) IC 261 (for channel 1), 262 (for channel 2,) 263 (for channel 3), and 264 (for channel 4). The "True" output of the FFs each light an LED 271-274 to indicate that a shock event has occurred. The "Inverted" output of the FFs 261-264 connect to the RF transceiver module 215 that transmits a message containing the present state of the four digital inputs when a negative going transition is sensed on one of its inputs. The RF module 215 transmits the message 3 times on 3 different frequencies for redundancy and then pulses the line labeled P2.7 (reference 280) which resets all of the Flip Flops 261-264. The output of the flip-flops 261-264 are connected to an the RF transceiver 215 via an FPGA (Field Programmable Gate Array) input pin which is part of the transceiver board design. Similarly, an output pin from the transceiver board's FPGA connects to the reset pin of the flip-flops 261-264.

In another embodiment, the outputs from a plurality of shock sensors are fed to a one-shot pulse stretcher circuit and used either alone or used as an initial trigger. The outputs of the analog sensors, such as a microphone, are compared against a settable threshold on a comparator whose output is then used as a trigger to switch on the power to transmitter to start data acquisition. Since the vibrations resulting from an impact on steel or similar materials are typically several milliseconds long, the trigger and subsequent switching on of the rest of the circuitry upon receipt of the shock does not generally result in loss of meaningful data.

Figure 3:
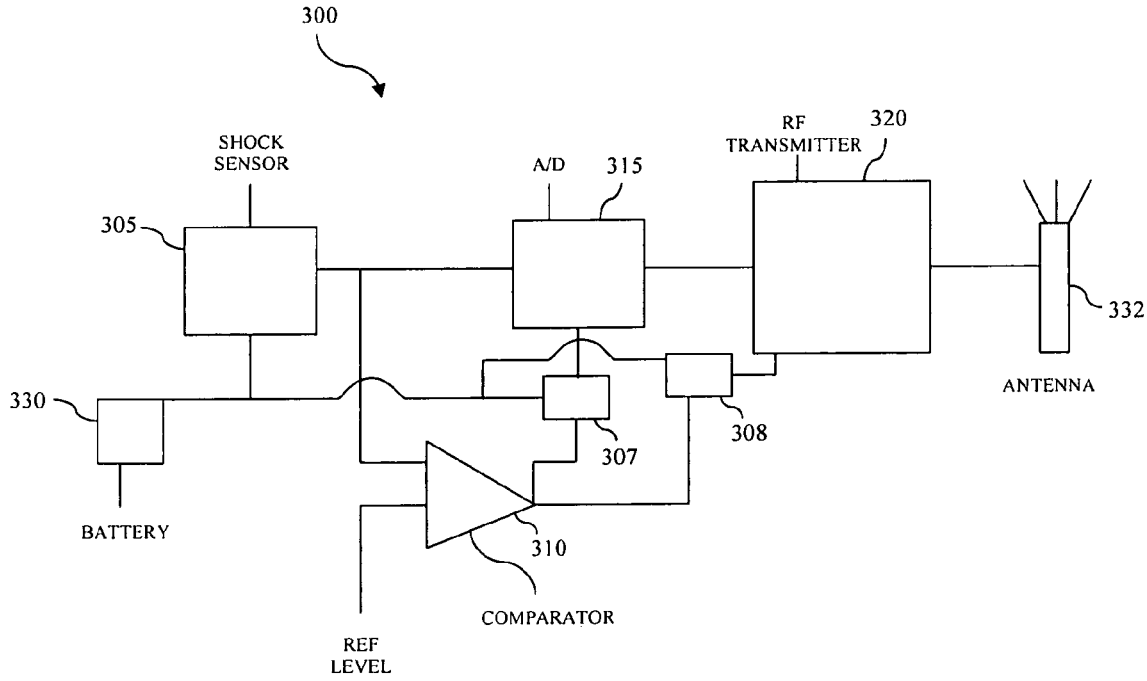
FIG. 3 shows a low-power shock detection system for measuring occasional shock events.

FIG. 3 shows a low-power shock detection system 300 for measuring occasional (intermittent) shock events. System includes shock sensor 305, comparator 310, A/D 315, RF transmitter 320 and antenna 322. Battery 330 provides electrical power to system 300. Although only one shock sensor 305 is shown, system can include a plurality of shock sensors. An output of shock sensor 305 is connected to one input of comparator 310. If needed, a converter from the sensor measurable to voltage may be required. When the magnitude of the shock expressed in volts is greater than the reference voltage level applied to the other input of comparator 310, the output of comparator gets pulled high. The output of comparator is tied to switches 307 and 308. When the comparator is high, the switches 307 and 308 are closed allowing power from battery to be provided to A/D 315 and RF transmitter 320. Thus, upon receipt of a shock above a predetermined level determined by the reference voltage level applied to comparator 310, A/D operation as well as transceiver operation is begun allowing shock data to be collected, processed and transmitted.

Although shock sensor is shown connected directly to battery 330, in certain embodiments, shock sensor 305 does not require external power, such as when based on piezoelectrics.

Moreover, although not shown, a shock switch, such as shock switch 105 can be placed in series with the supply line from battery to sensor 305 so that shock sensor only draws power after a triggering event.

The output of ADC 315 can be read by a dedicated field programmable gate array (FPGA; not shown). In this embodiment, the data acquired by the FPGA is then preferably pseudo-noise (P/N) coded using direct-sequence spread spectrum (DSSS) techniques and RF transmitted by RF transmitter 322, such as at 916 MHz. The receiver at the user end (not shown) can then read the data, decode it and display it on a screen.

Systems according to the invention can include a plurality of sensors, both shock and linear, deployed with suitable processing to improve false-positive triggers or to give improved position identification Using sensors based on different principles to detect the same event provides a method whereby one could evaluate both signals, the digital and the analog, and evaluate them to conclude whether an impact did take place or whether the indication was a malfunctioning detector. In another embodiment, readings from analog sensors placed at different parts of the tank would vary linearly proportional to the distance from the impact. This could be used to find the position of the impact.

Figure 4:
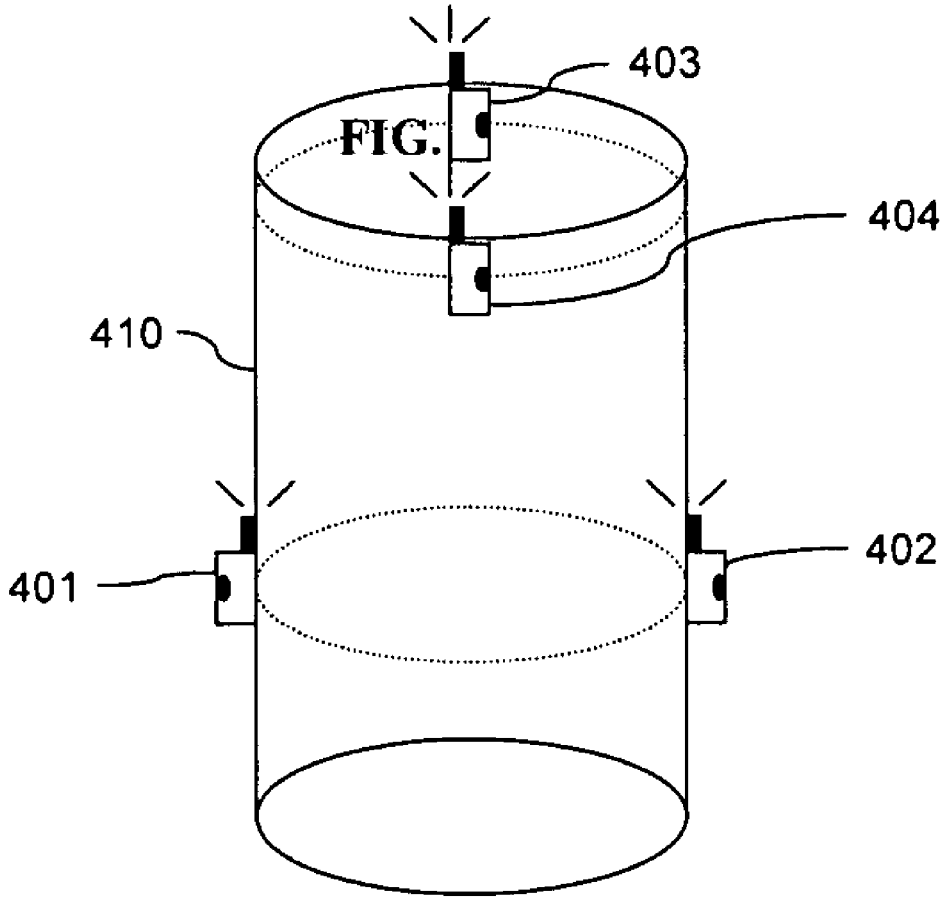
FIG. 4 shows a schematic of a sensor system having four linear transducers mounted at different positions on the same tank. In such an arrangement, different time and amplitude signatures are produced from the same impact depending upon their respective distance from the impact allowing the position of the impact to be determined.

Three or more linear transducers mounted at different positions on the same tank can be used to produce different time and amplitude signatures to the same impact depending upon their distance from the impact. FIG. 4 shows a schematic of a sensor system 400 having four linear transducers 401-404 mounted at different positions on the same tank 410. In such an arrangement, different time and amplitude signatures are produced from the same impact depending upon their respective distance from the impact. Good overall coverage can be achieved using at least four linear transducers, such as sensors 401 and 402 placed at diametrically opposite ends of the same horizontal plane of the tank and sensors 403 and 404 placed on a different horizontal plane, also diametrically opposite to each other, but midway between the first two sensors 410 and 402. The linear transducer closest to the impact would see a large input signal at the fastest time. However, the sensor furthest from the impact will see a smaller impact signal amplitude due to the damping of the signal and at a delay time of arrival as it travels a longer distance from the source to the sensor. Knowledge of the tank material characteristics and the spatial positions of the sensors enables the plotting of a time domain map that can be used to locate the position of the impact.

As noted above, impact sensors according to the invention can be used to detect impacts on critical infrastructure. In a preferred embodiment of the invention impacts above a predetermined threshold, or in a given range or ranges of impact forces, are used to trigger other sensors, such as one or more chemical sensors placed in close vicinity to the shock sensor system, such as to detect leaks of chemicals. As used herein, "close vicinity" refers to a distance of generally less than 200 feet. For example, the combined impact and chemical sensor can be used to identify and quantify a leak created by impact and puncture of a chemical storage facility. An example for this system is a sensor designed to detect leaks of hydrocarbons induced by impact of a hydrocarbon storage tank. The combined shock and chemical sensor system can be considered an "on-demand" sensor.

Systems according to the invention will materially contribute to countering terrorism. As noted in the background, energy asset storage tanks are vulnerable to malicious acts, such as terrorist attacks, with potentially serious consequences including fire, explosion, environmental damage, potential loss of life, and economic losses due to release of materials and damage to infrastructure. The invention provides protection of critical infrastructure such as energy storage facilities that store gasoline and other hydrocarbons which are generally spread over a large land expanse, as well as the residents proximate to such critical infrastructure. When embodied with chemical sensors placed in close vicinity to the shock sensor system, chemical leaks can be identified and quantified thus allowing rapid assessment and prompt corrective action, as well as evacuation to be initiated when appropriate.

Figure 5A:
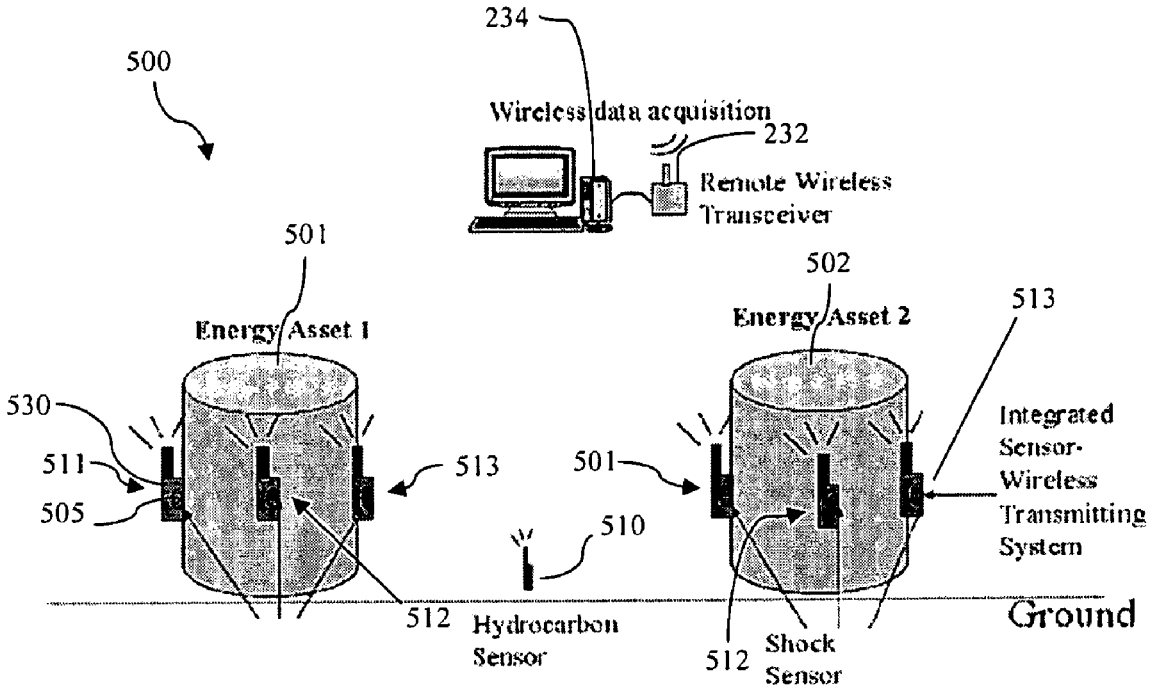
FIG. 5(*a*) shows a schematic of an impact and hydrocarbon sensor system according to an embodiment of the invention, while FIG. 5(*b*) shows a more detailed schematic of the hydrocarbon sensor system portion.
Figure 5B:
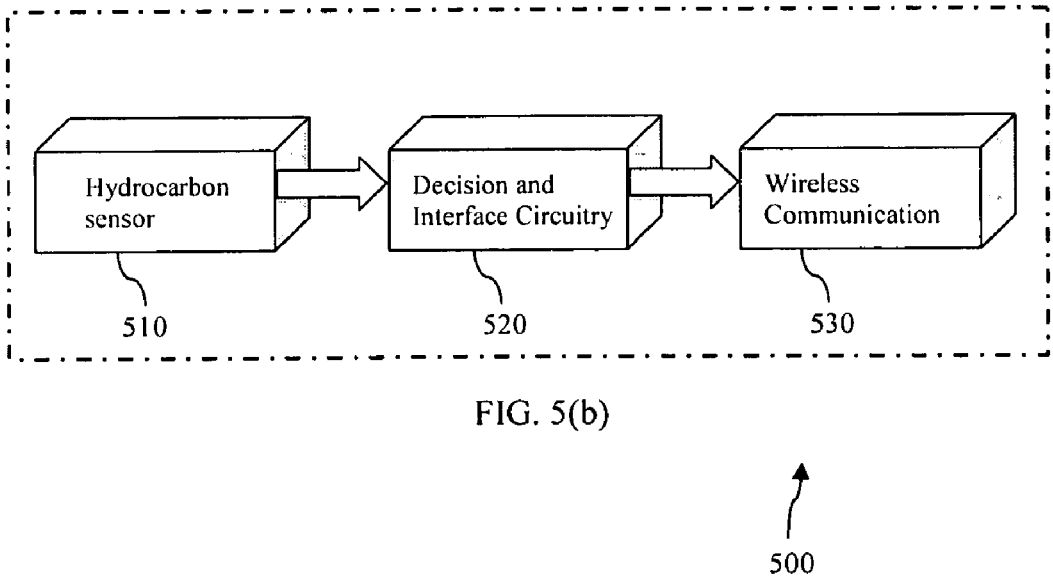

FIG. 5(*a*) shows a schematic of an impact and hydrocarbon sensor system 500 according to an embodiment of the invention, while FIG. 5(*b*) shows a more detailed schematic of the hydrocarbon sensor system portion 500. Three (3) shock sensor systems 511 comprising a shock sensor 505, interface circuitry and wireless transceiver 530 are shown attached to both energy asset 501 and energy asset 502. A significant advantage of system 500 is that the hydrocarbon sensor 510 is only on when necessary, thus resulting in reduced power consumption and minimization of the data generated by the system. The wireless communication equipment 530 component sends a wireless signal to both the remote monitoring location 230 and the hydrocarbon sensor 510 when triggered. The hydrocarbon sensor system 550 will respond to this trigger as follows:

1. The decision and interface board 520 will receive a signal from the wireless shock sensor that the shock sensor has been triggered.
2. This signal will be sent to the microprocessor (not shown) on the interface board 520.
3. The microprocessor will throw the relay on to supply power to the hydrocarbon sensor 510 and wait for power up or will trigger data collection if already on.
4. The sensor current signal from hydrocarbon sensor 510 is converted to a voltage signal and input to the A/D port of microprocessor (not shown).
5. The microprocessor on interface board 520 will sample port after a first period of time (e.g. 5 minutes) and store the signal.
6. The microprocessor will then sleep for a second period of time (e.g. 15 minutes) and measure the signal again.
7. The microprocessor will measure again after a third period of time (e.g. 30 minutes).
8. If any of these signals are above a predetermined set threshold, an alarm will be sent by wireless communications system 530 to wireless system 230 at a manned (or automatically monitored) point with a general user interface to a remotely located computer.
9. Otherwise, the event will be flagged as false signal.

The information regarding impact can be communicated to a user through screen capture on a front-end module used to interact with the user. There is the potential to attach to multiple triggers. The exact switch that triggered the wireless communication can be displayed in the front-end panel with the time of event. The event is preferably also recorded in a log file with a date and time stamp along with a suitable unique identifying code (e.g. hexadecimal code) showing the triggered switch.

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

We claim:

1. A low-power shock sensing system, comprising:

at least one shock sensor physically coupled to a chemical storage tank to be monitored for impacts, wherein the shock sensor comprises at least one mechanically activated sensor coupled to at least one mechanical shock switch having an open and a closed state, the closed state being mechanically initiated by the mechanically activated sensor in response to the mechanically activated sensor receiving a shock greater than a predetermined threshold, and wherein the shock sensor further comprises a linear transducer for generating a shock signal, said shock signal comprising an analog output signal;

a comparator for receiving the shock signal and comparing an amplitude of the analog output signal to the predetermined threshold to determine whether the shock signal indicates the shock is greater than the predetermined threshold;

an RF transmitter, the RF transmitter being in a low-power idle state in the absence of a triggering signal; and interface circuitry for generating the triggering signal, the interface circuitry activated by the shock switch being in the closed state or the comparator determining the shock signal is greater than the predetermined threshold, wherein an output of the interface circuitry is coupled to an input of the RF transmitter, and wherein the interface circuitry triggers the RF transmitter with the triggering signal to transmit an alarm message to at least one remote location.

2. The system of claim 1, wherein the RF transmitter comprises an RF transceiver.

3. The system of claim 1, wherein the remote location includes a wireless transceiver system.

4. The system of claim 1, wherein the interface circuitry comprises a processor having an adjustable sensitivity to a shock signal received from the shock sensor, the shock signal being representative of the closed state of the shock switch.

5. The system of claim 1, further comprising a battery, wherein the RF transmitter is powered exclusively by the battery.

6. The system of claim 1, wherein the at least one shock sensor comprises a plurality of shock sensors.

7. The system of claim 6, wherein the plurality of shock sensors have different ones of the predetermined thresholds.

8. The system of claim 6, wherein the plurality of shock sensors comprise at least three of the shock sensors, the plurality of shock sensors being situated on two or more planes.

9. The system of claim 1, wherein the system comprises a plurality of chemical storage tanks.

10. The system of claim 1, further comprising a chemical sensor having RF communications disposed remotely and within a communicable range from the chemical storage tank, wherein the chemical sensor is in a low-power idle mode absent activation by receipt of an activation signal from the RF transmitter.

11. The system of claim 1, further comprising an explosion-proof housing, wherein the shock switch, the RF transmitter and the interface circuitry are at least partially disposed therein.

12. The system of claim 1, wherein the chemical tank comprises a hydrocarbon storage tank having a fuel therein.

13. The system of claim 1, wherein the shock sensor comprises a cantilever spring.

14. The system of claim 1, wherein the shock sensor comprises a diaphragm.

15. The system of claim 1, wherein the at least one shock sensor is a plurality of shock sensors.

16. A computer-readable storage medium of a computing device, the storage medium comprising computer instructions for causing the computing device to perform the steps of:

receiving a shock signal from a linear transducer physically coupled to a chemical storage tank to be monitored for impacts;

determining whether the shock signal indicates a shock greater than a predetermined threshold using a comparator that compares an amplitude of an analog output signal of the linear transducer to the predetermined threshold; and transmitting a triggering signal to an RF transmitter when the shock is greater than the predetermined threshold, the triggering signal being adapted to cause the RF transmitter to transmit an alarm message to at least one remote location, the RF transmitter being in a low-power idle state in the absence of the triggering signal.

17. The storage medium of claim 16, further comprising computer instructions for causing the computing device to adjust the predetermined threshold.

18. The storage medium of claim 16, further comprising computer instructions for causing the computing device to receive another shock signal from a shock sensor physically coupled to the chemical storage tank to be monitored for impacts, wherein the shock sensor comprises at least one mechanically activated sensor coupled to at least one mechanical shock switch having an open and a closed state, the closed state being mechanically initiated by the mechanically activated sensor in response to the mechanically activated sensor receiving the shock greater than the predetermined threshold.

19. A method of monitoring for shock associated with a storage tank, the method comprising:

receiving a first shock signal from a linear transducer physically coupled to the storage tank to be monitored for impacts;

determining whether the first shock signal indicates a shock greater than a predetermined threshold using a comparator that compares an amplitude of an analog output signal of the linear transducer to the predetermined threshold;

determining whether a mechanical shock switch is in a closed state, the mechanical shock switch being connected to a shock sensor physically coupled to the storage tank to be monitored for impacts, the shock sensor comprising a mechanically activated sensor coupled to the mechanical shock switch which has an open state and the closed state, the closed state being mechanically initiated by the mechanically activated sensor in response to the mechanically activated sensor receiving the shock greater than the predetermined threshold; and transmitting a triggering signal to an RF transmitter when the first shock signal is determined to indicate the shock being greater than the predetermined threshold or when the shock switch is in a closed state, the triggering signal being adapted to cause the RF transmitter to transmit an alarm message to at least one remote location.

* * * * *